US008915561B2

(12) United States Patent
Eichman et al.

(10) Patent No.: US 8,915,561 B2
(45) Date of Patent: Dec. 23, 2014

(54) FOLDING SLIDING SHELF

(71) Applicant: Electrolux Home Products, Inc., Charlotte, NC (US)

(72) Inventors: Jay Eichman, Campobello, SC (US); Carson Smith, Greer, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 0 days.

(21) Appl. No.: 13/828,241

(22) Filed: Mar. 14, 2013

(65) Prior Publication Data

US 2014/0265799 A1 Sep. 18, 2014

(51) Int. Cl.
*A47B 96/02* (2006.01)
*F25D 25/02* (2006.01)

(52) U.S. Cl.
CPC ..... *F25D 25/025* (2013.01)
USPC ..... 312/408; 108/108

(58) Field of Classification Search
CPC . F25D 25/024; F25D 25/02; F25D 2325/022; F25D 2325/021; A47B 96/02; A47B 96/025; A47B 96/027; A47F 3/06; A47F 5/0093
USPC ..... 312/408, 351, 410, 298, 302, 303; 108/106–108; 211/153; 62/382, 465, 62/441; 248/235, 243
See application file for complete search history.

(56) References Cited

U.S. PATENT DOCUMENTS

| | | | | | |
|---|---|---|---|---|---|
| 2,032,235 | A | | 2/1936 | Thomas | |
| 2,091,607 | A | * | 8/1937 | Nave | 211/153 |
| 2,103,885 | A | * | 12/1937 | Whalen | 312/404 |
| 2,319,470 | A | * | 5/1943 | Nobles | 211/153 |
| 2,352,345 | A | * | 6/1944 | Rundell | 211/153 |
| 3,625,371 | A | | 12/1971 | Dill | |
| 3,984,163 | A | | 10/1976 | Boorman, Jr. et al. | |
| 4,620,489 | A | * | 11/1986 | Albano | 108/105 |
| 4,735,470 | A | * | 4/1988 | Falk | 312/246 |
| 5,403,084 | A | * | 4/1995 | Kane et al. | 312/408 |
| 5,516,204 | A | | 5/1996 | Calvert et al. | |
| D387,780 | S | | 12/1997 | Sandlin et al. | |
| 5,720,230 | A | * | 2/1998 | Mansfield | 108/108 |

(Continued)

FOREIGN PATENT DOCUMENTS

| | | | |
|---|---|---|---|
| JP | 08-035765 | A | 2/1996 |
| JP | 2002-267350 | A | 9/2002 |
| WO | 2010/118492 | A2 | 10/2010 |

OTHER PUBLICATIONS

International Search Report issued in Application No. PCT/US2014/023208 dated Jul. 17, 2014.

(Continued)

*Primary Examiner* — Janet M Wilkens

(74) *Attorney, Agent, or Firm* — Pearne & Gordon LLP

(57) ABSTRACT

A refrigerator includes a shelf assembly positioned within a compartment. The shelf assembly includes a first shelf portion attached to a first slide and having at least one projection, and a second shelf portion attached to a second slide and having at least one receiving portion. The first and second shelf portions are movable between a retracted position and an extended position. The at least one projection selectively engages the at least one receiving portion. Further, the first shelf portion is movable between a lowered position and a raised position when the first shelf portion is in the retracted position.

20 Claims, 3 Drawing Sheets

(56) References Cited

U.S. PATENT DOCUMENTS

| | | | | |
|---|---|---|---|---|
| 5,788,094 | A | 8/1998 | Kim et al. | |
| 5,813,741 | A * | 9/1998 | Fish et al. | 312/408 |
| 6,227,636 | B1 | 5/2001 | Lye et al. | |
| 6,663,204 | B2 * | 12/2003 | Atalla et al. | 312/408 |
| 6,729,704 | B2 | 5/2004 | Ames | |
| 6,994,033 | B2 | 2/2006 | Kweon | |
| 7,258,317 | B1 * | 8/2007 | Nagel | 248/244 |
| 7,311,211 | B2 * | 12/2007 | Chung | 211/90.02 |
| 8,376,483 | B2 * | 2/2013 | Jung | 312/408 |
| 8,403,438 | B2 * | 3/2013 | Park et al. | 312/408 |
| 2003/0020387 | A1 | 1/2003 | Wing et al. | |
| 2003/0151340 | A1 | 8/2003 | Mathur et al. | |
| 2005/0109901 | A1 * | 5/2005 | Stitchick et al. | 248/235 |
| 2010/0253197 | A1 * | 10/2010 | Jung | 312/408 |

OTHER PUBLICATIONS

Written Opinion issued in Application No. PCT/US2014/023208 dated Jul. 17, 2014.

* cited by examiner

FOLDING SLIDING SHELF

FIELD OF THE INVENTION

The present invention relates generally to refrigerators, and more particularly, to a refrigerator with a foldable sliding shelf for supporting items.

BACKGROUND OF THE INVENTION

Traditional refrigerators have included conventional shelving arrangements. However, conventional shelving arrangements may not accommodate tall food items. For instance, taller food and drink items may not always fit on a shelf underneath a conventional shelving arrangement. As such, it would helpful to provide a shelving arrangement with a portion that can be pivoted upwards, thus creating a split shelf. This allows tall items to be stored on a lower shelf. It would also be helpful to provide a shelving arrangement that is slidable into and out of the fresh food compartment to allow a user to access items on the shelf more easily. Accordingly, a shelving arrangement that is both slidable and pivotable would be beneficial.

BRIEF SUMMARY OF THE INVENTION

The following presents a simplified summary in order to provide a basic understanding of some example aspects. This summary is not an extensive overview of the invention. Moreover, this summary is not intended to identify critical elements of the invention nor delineate the scope of the invention. The sole purpose of the summary is to present some concepts in simplified form as a prelude to the more detailed description that is presented later.

In accordance with one aspect, a refrigerator is provided comprising a fresh food compartment, a shelf assembly positioned within the fresh food compartment, the shelf assembly including a first shelf rail and a second shelf rail, the first and second shelf rails being attached to the fresh food compartment, a first slide and a second slide, the first slide being movably attached to the first shelf rail and the second slide being movably attached to the second shelf rail, wherein the first slide and the second slide are slidingly movable between a retracted position and an extended position, a first shelf portion attached to the first slide, the first shelf portion including at least one projection, and a second shelf portion attached to the second slide, the second shelf portion including at least one receiving portion, the at least one receiving portion configured to selectively engage the at least one projection of the first shelf portion, wherein each of the first shelf portion and the second shelf portion are slidingly movable between the retracted position and the extended position.

In accordance with another aspect, a refrigerator is provided comprising a fresh food compartment, a shelf assembly positioned within the fresh food compartment, the shelf assembly including a first slide and a second slide, the first slide and the second slide each attached within the fresh food compartment, wherein the first slide and the second slide are movable between a retracted position and an extended position, a first shelf portion attached to the first slide for sliding movement and also pivotably attached to the first slide for pivoting movement between a lowered position and a raised position, the first shelf portion including at least one projection, and a second shelf portion attached to the second slide, the second shelf portion including at least one receiving portion configured to engage the at least one projection of the first shelf portion, wherein the second shelf portion is slidingly movable between the retracted position and the extended position, wherein the first shelf portion is slidingly movable between the retracted position and the extended position only when in the lowered position.

In accordance with another aspect, a refrigerator is provided comprising a fresh food compartment, a shelf assembly positioned within the fresh food compartment, the shelf assembly including a first shelf rail and a second shelf rail, the first and second shelf rails being attached to the fresh food compartment, a first slide and a second slide, the first slide being movably attached to the first shelf rail and the second slide being movably attached to the second shelf rail, wherein the first slide and the second slide are movable between a retracted position and an extended position, a central slide positioned between the first slide and the second slide and extending in a substantially parallel direction to the first slide and the second slide, the central slide being movable between the retracted position and the extended position, a first shelf portion attached to the first slide for sliding movement and also pivotably attached to the first slide for pivoting movement between a lowered position and a raised position, and a second shelf portion attached to the second slide and the central slide, wherein the first shelf portion and the second shelf portion are slidingly movable between the retracted position and the extended position when the first shelf portion is in the lowered position.

BRIEF DESCRIPTION OF THE DRAWINGS

The foregoing and other aspects of the present invention will become apparent to those skilled in the art to which the present invention relates upon reading the following description with reference to the accompanying drawings, in which.

DETAILED DESCRIPTION OF THE INVENTION

Figure 1:
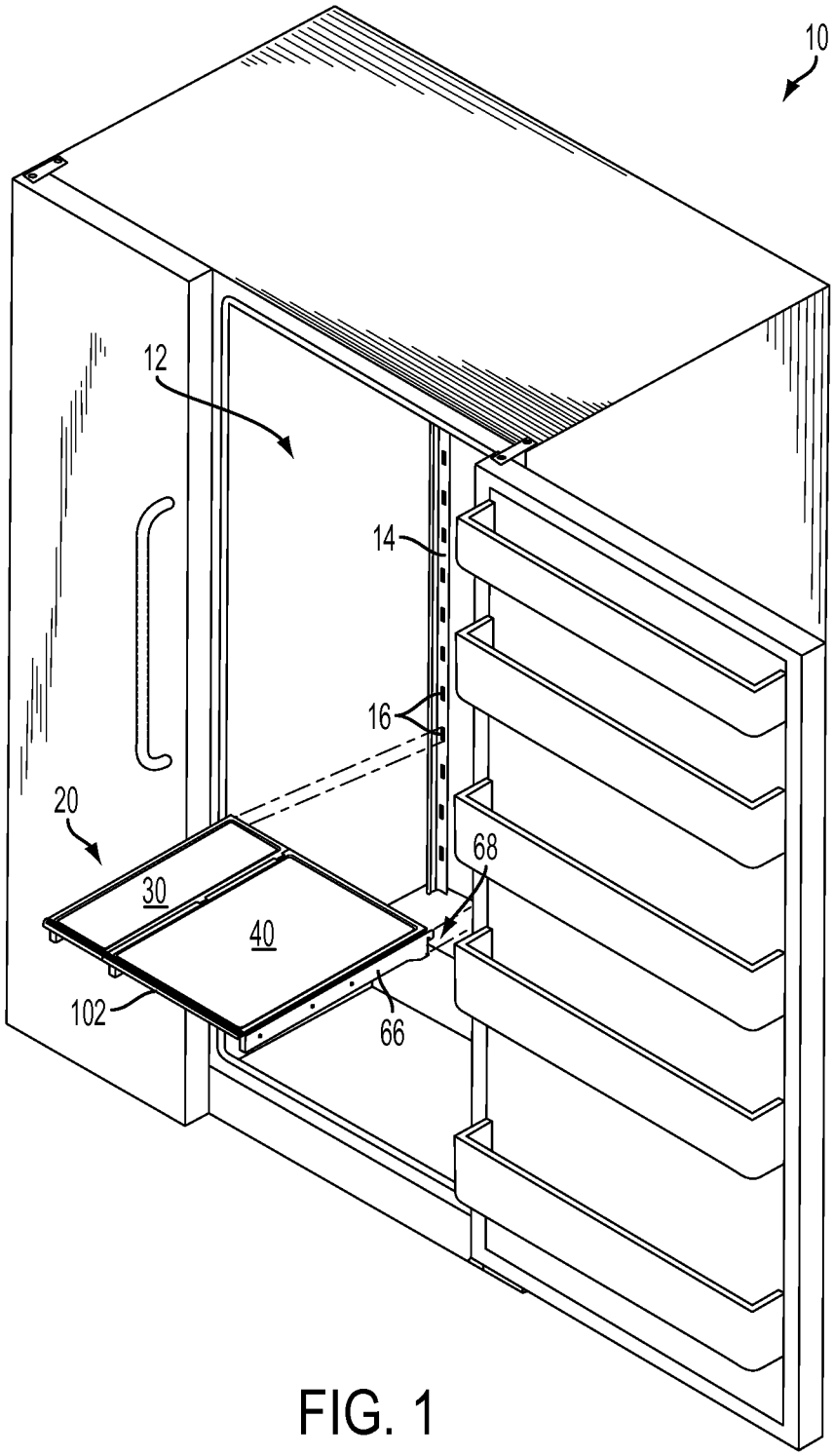
FIG. 1 is an exploded perspective view of a refrigerator including a shelf assembly.

Example embodiments that incorporate one or more aspects of the present invention are described and illustrated in the drawings. These illustrated examples are not intended to be a limitation on the present invention. For example, one or more aspects of the present invention can be utilized in other embodiments and even other types of devices. Moreover, certain terminology is used herein for convenience only and is not to be taken as a limitation on the present invention. Still further, in the drawings, the same reference numerals are employed for designating the same elements.

Referring to the example of FIG. 1, a refrigerator 10 is shown. The refrigerator 10 may include a compartment 12 and one or more refrigerator doors that provide access to an interior portion of the compartment 12. While not shown in the example, the refrigerator 10 can also include a cooling system with a compressor, heat-exchange pipes, an expansion valve, refrigerant, etc. in order to cool the fresh food compartment. The refrigerator 10 can further include a shelf assembly 20. The shelf assembly 20 can provide a surface upon which items, such as food and drink items, can be placed. As will be described in more detail below, the shelf assembly 20 can have a sliding feature and/or a pivoting feature.

While FIG. 1 illustrates a two compartment refrigerator, the refrigerator 10 can also include a single compartment or more than two compartments. Moreover, if provided with two or more compartments, one or more compartments may by positioned above the other and/or laterally with respect to one another. For instance, the refrigerator 10 can include a French-door style refrigerator having a bottom mounted freezer compartment. Still further, one compartment may be located partially or entirely within another compartment. Similarly, either one or both compartments may be maintained at a temperature above or below freezing providing for two freezer compartments, two fresh food compartments, or one freezer compartment and one fresh food compartment. It is to be understood that the refrigerator 10 shown and described herein can comprise various temperatures, such that the compartments can functionally be below freezing to act as a freezer compartment or above freezing to act as a fresh food compartment.

The compartment 12 can further include a bracket 14 with one or more openings 16. The bracket 14 can extend within an interior wall of the compartment 12, such as a rear wall. The bracket 14 can extend vertically along the wall, and can be either formed integrally with the wall, or can be attached as a separate structure. As will be described in more detail below, the one or more openings 16 can be sized to receive attachment structures providing for attachment of the shelf assembly 20 within the compartment 12. In further examples, the compartment 12 may not include the bracket 14 and, instead, the one or more openings 16 can be formed directly in a wall of the compartment 12. In such an example, the shelf assembly 20 may not be attached to the bracket 14 and, instead, may be attached directly to the wall of the compartment 12.

Figure 2:
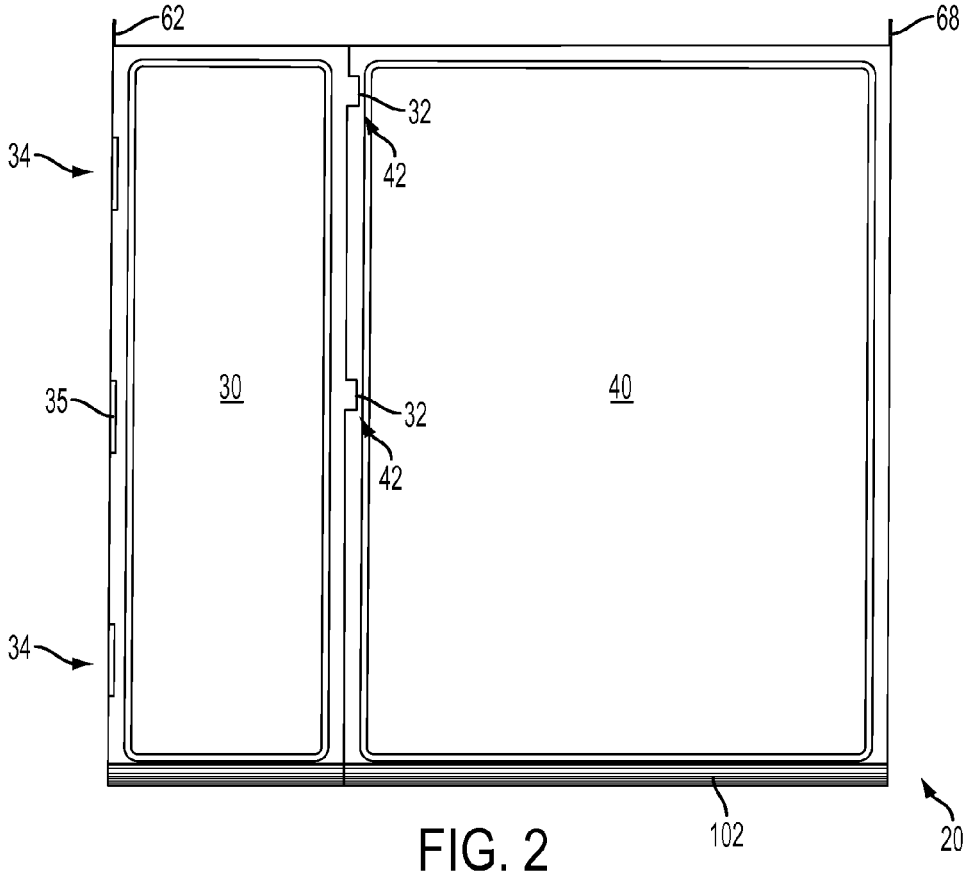
FIG. 2 is a top plan view of the shelf assembly shown in FIG. 1.

Referring now to FIG. 2, the shelf assembly 20 is shown. The shelf assembly 20 can include a first shelf portion 30 upon which items, such as food and/or drink items, can be placed. The first shelf portion 30 can include a substantially planar surface defining a shelf plane. The first shelf portion 30 can be at least partially transparent, as shown in the drawings, or could be opaque. The first shelf portion 30 can be partially or completely formed from glass, plastic, metal, or any number of different materials. The first shelf portion 30 can further include a ridge, ledge, or surrounding structure that substantially surrounds a perimeter of the planar surface, such that liquid spilled onto the first shelf portion 30 is inhibited from leaking out of the first shelf portion 30.

The first shelf portion 30 can include one or more projections 32. In the shown example, the first shelf portion 30 includes two projections, however, it is to be understood, that as few as one projection or more than two projections are also contemplated. The one or more projections 32 are shown to be substantially rectangularly shaped and extend outwardly from an outer perimeter of the first shelf portion 30. However, the one or more projections 32 could take on any number of different shapes, such as square, triangular, circular, or the like, while still retaining a similar function to the one or more projections 32 in the shown example. The one or more projections 32 are shown to be positioned on one half of the first shelf portion 30 and closer to one side of the first shelf portion 30 (a rear side in the shown examples), however, the one or more projections 32 could be positioned and spaced along any part of the first shelf portion 30. For instance, the one or more projections 32 could be positioned closer to a front surface of the first shelf portion 30, or could be spaced wider apart from each other. As such, it is to be understood that the one or more projections 32 in the shown example are not intended to be limiting in structure, and any number of sizes, shapes, configurations, placements, or the like are contemplated. The one or more projections 32 can extend along a direction that is substantially parallel to the shelf plane.

The first shelf portion 30 can further include one or more hinges 34. As will be described in more detail below, the one or more hinges 34 can provide for pivotal attachment between the first shelf portion 30 and a first bracket 90. As such, the first shelf portion 30 can be pivoted between a lowered position, shown in FIG. 2, and a raised position, shown in FIGS. 5-6.

The first shelf portion 30 can further include a stop member 35. The stop member 35 can be positioned along an edge of the first shelf portion 30. The stop member 35 is shown to be positioned between the one or more hinges 34, however, a variety of positions are contemplated, such as in front of or behind the hinges 34. As will be described in more detail below, the stop member 35 can inhibit the first shelf portion 30 from moving from a retracted position to an extended position while the first shelf portion 30 is in a raised position. Similarly, the stop member 35 can further function by inhibiting the first shelf portion 30 from being raised while in the extended position. The stop member 35 may include a number of structures and configurations that act as a stop to carry out the functions described herein.

Referring still to FIG. 2, the shelf assembly 20 can further include a second shelf portion 40. The second shelf portion 40 can include a substantially planar surface upon which items, such as food and/or drink items, can be placed. As with the first shelf portion 30, the second shelf portion 40 can be at least partially transparent, as shown in the drawings, or could be opaque. The second shelf portion 40 can include glass, plastic, metal, or any number of different materials. The second shelf portion 40 can further include a ridge, ledge, or surrounding structure that substantially surrounds the planar surface, such that liquid spilled onto the second shelf portion 40 is inhibited from leaking out of the second shelf portion 40. The second shelf portion 40 can be positioned adjacent and in selective engagement with the first shelf portion 30. The second shelf portion 40 can be larger in area than the first shelf portion 30, as shown in FIG. 2, however, other sizes and shapes are also contemplated.

The second shelf portion 40 can include one or more receiving portions 42 that are sized and shaped to engage the one or more projections 32 of the first shelf portion 30. As such, the one or more receiving portions 42 can receive the one or more projections 32. The one or more receiving portions 42 can define a substantially hollow space into which the one or more projections 32 can be inserted. The one or more receiving portions 42 can be slightly larger in size than the one or more projections 32. The one or more receiving portions 42 can also include a shape that substantially matches the shape of the one or more projections 32. For instance, both the one or more projections 32 and one or more receiving portions 42 are shown to be substantially rectangular in shape, however, other shapes are contemplated for both. Additionally, the one or more receiving portions 42 are shown to be positioned on a rear half of the second shelf portion 40 at a substantially opposing location from the one or more projections 32. However, it is to be understood that the one or more receiving portions 42 can be positioned at a variety of positions along a side of the second shelf portion 40 to match the position of the one or more projections 32.

In further examples, the location of the one or more projections 32 and one or more receiving portions 42 could be switched. Specifically, the second shelf portion 40 could include the one or more projections 32 while the first shelf portion 30 includes the one or more receiving portions 42. In such an example, the one or more projections 32 and one or more receiving portions 42 could take on a number of different shapes, sizes, and configurations, as described above.

The shelf assembly 20 can further include a cover 102. The cover 102 can partially or completely cover a portion of either or both of the first shelf portion 30 and second shelf portion 40. In the shown example, the cover 102 includes two covers, with one cover being installed on the first shelf portion 30 and a second cover being installed on the second shelf portion 40 such that the cover 102 can be movable, such as by being pivotable and/or slidable, therewith. The covers 102 can be installed on a front portion of the first shelf portion 30 and second shelf portion 40. The covers 102 can be rubber, plastic, or any number of materials, and can improve gripping and aesthetics of the first shelf portion 30 and second shelf portion 40.

Figure 3:
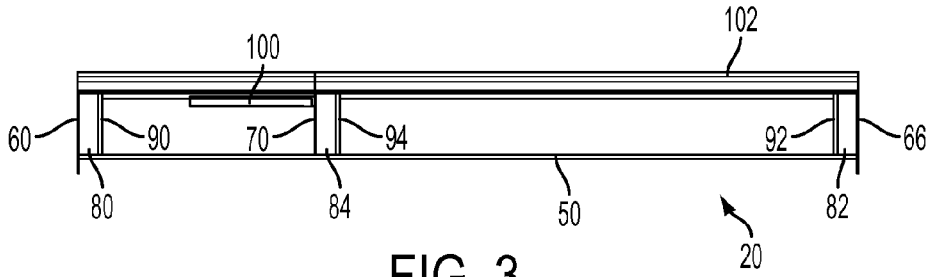
FIG. 3 is a front elevation view of the shelf assembly shown in FIG. 1.

Referring now to FIGS. 1 and 3, a front elevation view of the shelf assembly 20 is shown. The shelf assembly 20 can further include a first shelf rail 60 and a second shelf rail 66. The first shelf rail 60 and second shelf rail 66 can be positioned at opposing sides of the shelf assembly 20. The first shelf rail 60 and the second shelf rail 66 can each define an elongated, substantially planar structure that extends from a front portion of the shelf assembly 20 to a rear portion of the shelf assembly 20. The first shelf rail 60 can be positioned adjacent and below a side of the first shelf portion 30. The second shelf rail 66 can be positioned adjacent and below a side of the second shelf portion 40. While the shown examples include two attachment structures, it is to be understood that more or fewer attachment structures are contemplated.

The first shelf rail 60 and the second shelf rail 66 can include a first attachment structure 62 and a second attachment structure 68, respectively. The first and second attachment structures 62, 68 can each include one or more projections, hooks, or the like, that are sized and shaped to be inserted into the openings 16. Once inserted, the first and second attachment structures 62, 68 can be removably attached to the openings 16 in the compartment 12. The first and second attachment structures 62, 68 are not limited in size, shape, and structure of the shown examples, and can take on a number of configurations that function to attach the shelf assembly 20 to the compartment 12. Similarly, the first and second attachment structures 62, 68 can be made of a sufficiently strong and resilient material such that the shelf assembly 20 and food or drink items can be fully supported within the compartment 12.

The shelf assembly 20 can further include a rear support 50. The rear support 50 can extend across a rear portion of the shelf assembly 20 from the first shelf portion 30 to the second shelf portion 40. Specifically, the rear support 50 can extend between the first shelf rail 60 to the second shelf rail 66. The rear support 50 can define an elongated, substantially planar surface. Opposing ends of the rear support 50 can be attached to the first shelf rail 60 and the second shelf rail 66, respectively. The rear support 50 can be attached to the first shelf rail 60 and the second shelf rail 66 in any number of ways, such as by welding, snap fit means, adhesives, screws, or the like. The rear support 50 can provide support to the ends of the first and second shelf rails 60, 66.

The shelf assembly 20 can further include a central support 70. The central support 70 can extend in a parallel direction to the first and second shelf rails 60, 66. The central support 70 can extend from the rear support 50 to a front portion of the shelf assembly 20. The central support 70 can be attached to the rear support 50 in any number of ways, such as by welding, snap fit means, adhesives, screws, or the like. The central support 70 is not shown to include attachment structures, but it is to be understood that in further examples, the central support 70 may be provided with attachment structures similar to the first and second attachment structures 62, 68 described above. The central support 70 can be positioned underneath a side of the second shelf portion 40. The central support 70 can be positioned on an opposite side of the second shelf portion 40 from the second shelf rail 66.

Referring still to FIG. 2, the shelf assembly 20 can further include a first slide 80, second slide 82, and a central slide 84. The first slide 80 can be attached to the first shelf rail 60, the second slide 82 can be attached to the second shelf rail 66, and the central slide 84 can be attached to the central support 70. The first slide 80, second slide 82, and central slide 84 can provide for movement with respect to the first shelf rail 60, second shelf rail 66, and central support 70, respectively. For instance, the slides 80, 82, 84 can include a variety of different types of slides, such as a ball bearing extension slide, telescoping rail, drawer slide, etc. In one example, the slides 80, 82, 84 can each include two portions: a stationary portion and a translating portion. The stationary portion of each of the slides can be attached to the first shelf rail 60, second shelf rail 66, and central support 70, respectively. The translating portion can move with respect to the stationary portion, such that the stationary portion remains stationary while the translating portion moves. Accordingly, while the stationary portion remains fixedly attached, the translating portion can slide between a retracted position (shown in FIG. 4) and an extended position (shown in FIG. 7). It is to be understood that the description of the slides 80, 82, 84 is only generically explained, and can take on a number of different functions and/or structures depending on the specific type of slide being used. As such, the slide description disclosed herein is not intended to be limiting, and is merely provided to explain the function of one example slide.

The first slide 80, second slide 82, and central slide 84 can be attached to the first shelf rail 60, second shelf rail 66, and central support 70 in any number of ways. For instance, one or more openings can be provided to allow for a screw attachment, mechanical fastening device, or the like. Similarly, adhesives, welding, snap fit means, or the like can be used to attach the first slide 80, second slide 82, and central slide 84 to the first shelf rail 60, second shelf rail 66, and central support 70.

The shelf assembly 20 can further include a first bracket 90, second bracket 92, and central bracket 94. The first bracket 90, second bracket 92, and central bracket 94 can each be attached to the first slide 80, second slide 82, and central slide 84, respectively. Specifically, the first bracket 90, second bracket 92, and central bracket 94 can be attached to the translating portions of the first slide 80, second slide 82, and central slide 84. The first bracket 90, second bracket 92, and central bracket 94 can be attached to the translating portions of the slides 80, 82, 84 in a number of ways. For instance, the attachment could be by screw attachment between one or more openings, adhesives, welding, snap fit means, or the like. Accordingly, the brackets 90, 92, and 94 can move with the translating portion of the slides 80, 82, 84 between the retracted and extended position.

The first bracket 90 can also be attached to the first shelf portion 30. As shown, the first bracket 90 can be positioned underneath and along a side of the first shelf portion 30. Specifically, the first bracket 90 can extend underneath an outer perimeter side of the first shelf portion 30. The first bracket 90 can extend partially or completely along a length of the first shelf portion 30 from a front portion to a rear portion of the first shelf portion 30. The first bracket 90 can be parallel to both the first shelf rail 60 and first slide 80. The first bracket 90 can be attached to the first shelf portion 30 by the one or more hinges 34. The one or more hinges 34 can provide for a pivotal attachment between the first bracket 90 and first shelf portion 30. As such, the first shelf portion 30 can pivot with respect to the first bracket 90, the first shelf rail 60, and the first slide 80 via the one or more hinges 34 between the raised lowered position, shown in FIG. 4, and the raised position, shown in FIGS. 5-6.

The second bracket 92 can be attached to the second shelf portion 40. As shown, the second bracket 92 can be positioned underneath and along a side of the second shelf portion 40. Specifically, the second bracket 92 can extend underneath an outer perimeter side of the second shelf portion 40. The second bracket 92 can extend partially or completely along a length of the second shelf portion 40 from a front portion to a rear portion of the second shelf portion 40. The second bracket 92 can be parallel to both the second shelf rail 66 and second slide 82. The second bracket 92 can be attached to the second shelf portion 40 in a number of ways. For instance, the second bracket 92 and second shelf portion 40 can be attached by adhesives, snap fit means, screw and nut attachment, etc. In the alternative, the second bracket 92 and second shelf portion 40 could be integrally formed and/or integrally attached, such that the second bracket 92 and the second shelf portion 40 are functionally a single piece.

Along with the second bracket 92, the central bracket 94 can also be attached to the second shelf portion 40. The central bracket 94 can be positioned underneath and along a side of the second shelf portion 40. The central bracket 94 can be positioned along a side opposite from the second bracket 92. The central bracket 94 can extend partially or completely along a length of the second shelf portion 40 from a front portion to a rear portion of the second shelf portion 40. The central bracket 94 can be parallel to both the central support 70 and central slide 84. The central bracket 94 can be attached to the second shelf portion 40 in a number of ways. For instance, the central bracket 94 and second shelf portion 40 can be attached by adhesives, snap fit means, screw and nut attachment, etc. In the alternative, the central bracket 94 and second shelf portion 40 could be integrally formed and/or integrally attached, such that the central bracket 94 and the second shelf portion 40 are functionally a single piece.

Referring now to FIGS. 3-7, the shelf assembly 20 can include a corner bracket 100. The corner bracket 100 can be attached to both the rear support 50 and central support 70. The corner bracket 100 can be attached to both the rear support 50 and central support 70 in a number of ways, including, but not limited to, snap fit means, adhesives, welding, screw and nut attachment, etc. Alternatively, the corner bracket 100 could be integrally formed with either or both of the rear support 50 and central support 70, such that the corner bracket 100 and either or both of the rear 50 and central support 70 are formed as one piece. The corner bracket 100 can extend within a perimeter of the first shelf portion 30 and can provide for additional structural support in the attachment between the rear support 50 and central support 70.

Referring now to FIGS. 4-7, the operation of the shelf assembly 20 can now be described. It is to be understood that the shelf assembly 20 in FIGS. 4-7 is shown by itself and without the refrigerator 10 for purposes of clarity, such that the various positions of the shelf assembly 20 can be easily discerned and understood. As such, the shelf assembly 20 shown in FIGS. 4-7 is designed to be positioned within the refrigerator 10, and can achieve any of the shown positions while positioned within the refrigerator 10.

Figure 4:
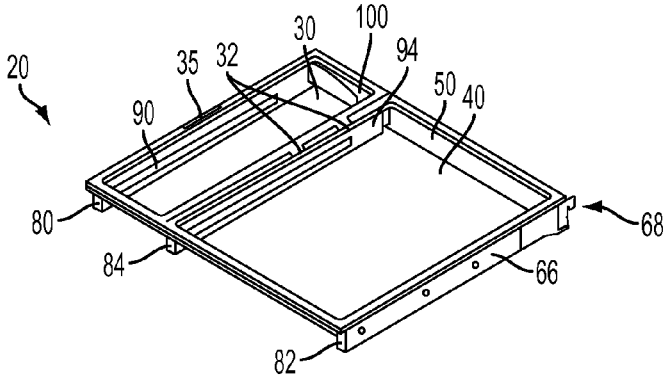
FIG. 4 is a perspective view of the shelf assembly shown in FIG. 1 with a first shelf portion and a second shelf portion in a retracted position.

Initially, as shown in FIG. 4, the shelf assembly 20 can be in a retracted position, in which both the first shelf portion 30 and second shelf portion 40 are fully retracted. In such a position, a rear edge of both the first shelf portion 30 and second shelf portion 40 is positioned adjacent and above the rear support 50. In the retracted position, the first shelf portion 30 and second shelf portion 40 together form a substantially planar surface such that food and/or drink items can be placed on either or both of the first shelf portion 30 and second shelf portion 40.

Figure 5:
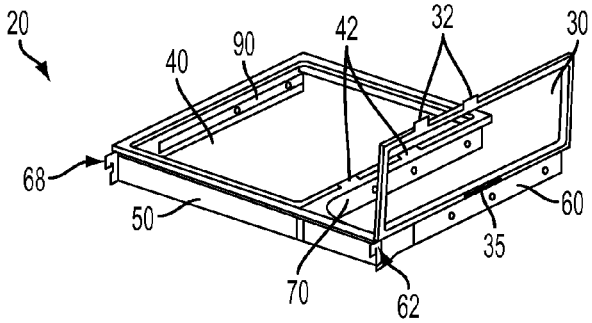
FIG. 5 is a perspective view of the shelf assembly with the first shelf portion in a raised position and the second shelf portion in the retracted position.

Referring now to FIG. 5, the shelf assembly 20 can be in the retracted position with the first shelf portion 30 in the raised position. In such a position, the rear edge of the second shelf portion 40 is positioned adjacent and above the rear support 50. The first shelf portion 30 can be pivoted upwardly via the one or more hinges 34, such that the first shelf portion 30 pivots with respect to the first bracket 90. In the raised position, the one or more projections 32 do not engage the one or more receiving portions 42. While in the raised position, food and/or drink items can be positioned on a shelf or planar structure at a location below the shelf assembly 20. If the food and/or drink items are sufficiently tall, such that they extend above the shelf assembly 20 in height, the first shelf portion 30 can be pivoted to the raised position such that the food and/or drink items can be accommodated.

Figure 6:
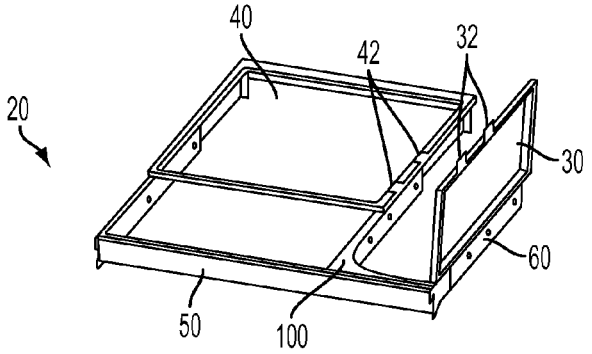
FIG. 6 is a perspective view of the shelf assembly with the first shelf portion in the raised position and the second shelf portion in an extended position.

Referring now to FIG. 6, the shelf assembly 20 can be in a partially extended position with one of the shelf portions in an extended position while the other shelf portion is in a retracted position. In the shown example, the second shelf portion 40 can be pulled into the extended position while the first shelf portion 30 remains in the retracted and raised position. The second shelf portion 40 can be moved into the extended position by a user pulling on the second shelf portion 40. Specifically, the user can grip the second shelf portion 40, such as the cover 102, and pull the second shelf portion 40 outwardly and towards the user. The second shelf portion 40 can slide outwardly due to the attachment to the second slide 82 and central slide 84 through the second bracket 92 and central bracket 94, respectively. The second shelf portion 40 can be slid from the extended position and into the retracted position by the user pushing the second shelf portion 40 inwardly and into the compartment 12.

In a further example, the first shelf portion 30 can be inhibited from moving from the retracted position to the extended position while the first shelf portion 30 is in the raised position. In such an example, the first shelf portion 30 can include the stop member 35 that inhibits the first shelf portion 30 from being extended while raised. The stop member 35 can further function to inhibit the first shelf portion 30 from being raised while extended. Accordingly, in this example, the first shelf portion 30 can move from the retracted position and into the extended position only when the first shelf portion 30 is in the lowered position.

Figure 7:
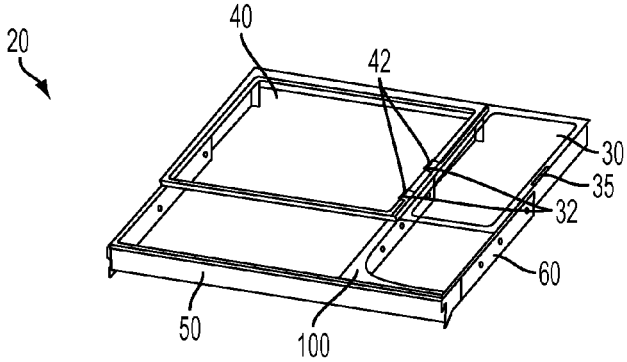
FIG. 7 is a perspective view of the shelf assembly with the first shelf portion and the second shelf portion in the extended position.

Referring now to FIG. 7, the shelf assembly 20 can be in a completely extended position with both the first shelf portion 30 and second shelf portion 40 in the extended position. In this example, the first shelf portion 30 is in the lowered position, such that the first shelf portion 30 and the second shelf portion 40, together, form a substantially planar surface. The one or more projections 32 of the first shelf portion 30 can engage the one or more receiving portions 42 of the second shelf portion 40, such that the one or more receiving portions 42 receive the one or more projections 32. Accordingly, a user can grip either of the first shelf portion 30 or the second shelf portion 40 and move the entire shelf assembly 20 from the retracted position and into the extended position or vice versa. Due to the engagement between the one or more projections 32 and one or more receiving portions 42, movement of either the first shelf portion 30 and second shelf portion 40 will cause the other of the first shelf portion 30 and second shelf portion 40 to move as well. For example, the user can pull (or push) the first shelf portion 30, thus causing the second shelf portion 40 to move. Likewise, the user can pull (or push) the second shelf portion 40, thus causing the first shelf portion 30 to move.

In a further example, the first shelf portion 30 can be inhibited from moving from the lowered position to the raised position while the first shelf portion 30 is in the extended position. In such an example, the first shelf portion 30 can include the stop member 35 that inhibits the first shelf portion 30 from being raised while extended. Accordingly, in this example, the first shelf portion 30 can move from the lowered position and into the raised position only when the first shelf portion 30 is in the retracted position.

The invention has been described with reference to the example embodiments described above. Modifications and alterations will occur to others upon a reading and understanding of this specification. Examples embodiments incorporating one or more aspects of the invention are intended to include all such modifications and alterations.

What is claimed is:

1. A refrigerator, comprising:

a fresh food compartment;

a shelf assembly positioned within the fresh food compartment, the shelf assembly including:

a first shelf rail and a second shelf rail, the first and second shelf rails being attached to the fresh food compartment;

a first slide and a second slide, the first slide being movably attached to the first shelf rail and the second slide being movably attached to the second shelf rail, wherein the first slide and the second slide are slidingly movable between a retracted position and an extended position;

a first shelf portion attached to the first slide, the first shelf portion including at least one projection, wherein the first shelf portion is configured to pivot between a lowered position and a raised position; and a second shelf portion attached to the second slide, the second shelf portion including at least one receiving portion, the at least one receiving portion configured to selectively engage the at least one projection of the first shelf portion;

wherein each of the first shelf portion and the second shelf portion are slidingly movable between the retracted position and the extended position, further wherein the first shelf portion includes a stop member that is configured to prevent the first shelf portion from pivoting between the lowered position and the raised position when the first shelf portion is in the extended position.

2. The refrigerator of claim 1, wherein the first shelf portion is pivotably attached with respect to the first slide.

3. The refrigerator of claim 2, wherein the first shelf portion includes at least one hinge, and the first shelf portion is pivotably attached with respect to the first slide via the at least one hinge.

4. The refrigerator of claim 3, wherein the first shelf portion defines a shelf plane and the at least one projection is configured to extend in a direction that is substantially parallel to the shelf plane.

5. The refrigerator of claim 1, wherein the projection is configured to engage the receiving portion when the first shelf portion is in the lowered position.

6. The refrigerator of claim 5, wherein the first shelf portion and the second shelf portion are slidingly movable substantially simultaneously between the retracted position and the extended position when the projection engages the receiving portion.

7. The refrigerator of claim 1, wherein movement between the extended and retracted positions by one of the first shelf portion and second shelf portion is configured to cause similar movement in the other of the first shelf portion and the second shelf portion when the projection is engaged with the receiving portion.

8. A refrigerator, comprising:

a fresh food compartment;

a shelf assembly positioned within the fresh food compartment, the shelf assembly including:

a first shelf rail and a second shelf rail, the first and second shelf rails being attached to the fresh food compartment;

a first slide and a second slide, the first slide being movably attached to the first shelf rail and the second slide being movably attached to the second shelf rail, wherein the first slide and the second slide are slidingly movable between a retracted position and an extended position;

a first shelf portion attached to the first slide, the first shelf portion including at least one projection, wherein the first shelf portion is configured to pivot between a lowered position and a raised position; and a second shelf portion attached to the second slide, the second shelf portion including at least one receiving portion, the at least one receiving portion configured to selectively engage the at least one projection of the first shelf portion;

wherein each of the first shelf portion and the second shelf portion are slidingly movable between the retracted position and the extended position, further wherein the first shelf portion includes a stop member that is configured to prevent the first shelf portion from moving from the retracted position to the extended position when the first shelf portion is in the raised position.

9. A refrigerator, comprising:

a fresh food compartment;

a shelf assembly positioned within the fresh food compartment, the shelf assembly including:

a first slide and a second slide, the first slide and the second slide each attached within the fresh food compartment, wherein the first slide and the second slide are movable between a retracted position and an extended position;

a first shelf portion attached to the first slide for sliding movement and also pivotably attached to the first slide for pivoting movement between a lowered position and a raised position, the first shelf portion including at least one projection; and a second shelf portion attached to the second slide, the second shelf portion including at least one receiving portion configured to engage the at least one projection of the first shelf portion, wherein the second shelf portion is slidingly movable between the retracted position and the extended position;

wherein the first shelf portion includes a stop member that is configured to prevent the first shelf portion from pivoting between the lowered position and the raised position when the first shelf portion is in the extended position.

10. The refrigerator of claim 9, further including a first bracket and a second bracket, wherein the first bracket is attached to each of the first shelf portion and the first slide, further wherein the second bracket is attached to each of the second shelf portion and the second slide.

11. The refrigerator of claim 10, further including a first shelf rail and a second shelf rail attached to the fresh food compartment, wherein the first shelf rail is attached to the first slide and the second shelf rail is attached to the second slide.

12. The refrigerator of claim 11, wherein the first shelf portion and second shelf portion are configured to be slidingly movable between the retracted and extended positions with respect to the first and second shelf rails.

13. The refrigerator of claim 9, wherein the at least one projection includes two projections and the at least one receiving portion includes two receiving portions.

14. A refrigerator, comprising:

a fresh food compartment;

a shelf assembly positioned within the fresh food compartment, the shelf assembly including:

a first shelf rail and a second shelf rail, the first and second shelf rails being attached to the fresh food compartment;

a first slide and a second slide, the first slide being movably attached to the first shelf rail and the second slide being movably attached to the second shelf rail, wherein the first slide and the second slide are movable between a retracted position and an extended position;

a central slide positioned between the first slide and the second slide and extending in a substantially parallel direction to the first slide and the second slide, the central slide being movable between the refracted position and the extended position;

a first shelf portion attached to the first slide for sliding movement and also pivotably attached to the first slide for pivoting movement between a lowered position and a raised position; and a second shelf portion attached to the second slide and the central slide;

wherein the first shelf portion and the second shelf portion are slidingly movable between the retracted position and the extended position when the first shelf portion is in the lowered position.

15. The refrigerator of claim 14, wherein the first shelf portion defines a shelf plane, and wherein the first shelf portion includes one or more projections configured to extend in a direction that is substantially parallel to the shelf plane.

16. The refrigerator of claim 15, wherein the second shelf portion includes one or more receiving portions that are shaped to receive the one or more projections.

17. The refrigerator of claim 16, wherein movement between the extended and retracted positions by one of the first shelf portion and second shelf portion is configured to cause similar movement in the other of the first shelf portion and the second shelf portion when the projection is engaged with the receiving portion.

18. The refrigerator of claim 14, wherein the first shelf portion includes a stop member that is configured to prevent the first shelf portion from pivoting between the lowered position and the raised position when the first shelf portion is in the extended position.

19. A refrigerator, comprising:

a fresh food compartment;

a shelf assembly positioned within the fresh food compartment, the shelf assembly including:

a first slide and a second slide, the first slide and the second slide each attached within the fresh food compartment, wherein the first slide and the second slide are movable between a retracted position and an extended position;

a first shelf portion attached to the first slide for sliding movement and also pivotably attached to the first slide for pivoting movement between a lowered position and a raised position, the first shelf portion including at least one projection; and a second shelf portion attached to the second slide, the second shelf portion including at least one receiving portion configured to engage the at least one projection of the first shelf portion, wherein the second shelf portion is slidingly movable between the retracted position and the extended position;

wherein the first shelf portion wherein the first shelf portion includes a stop member that is configured to prevent the first shelf portion from moving from the retracted position to the extended position when the first shelf portion is in the raised position.

20. The refrigerator of claim 19, wherein the first shelf portion is slidingly movable between the retracted position and the extended position only when in the lowered position.

* * * * *